US006877480B2

(12) United States Patent
Persson et al.

(10) Patent No.: US 6,877,480 B2
(45) Date of Patent: Apr. 12, 2005

(54) IDLE SPEED COMPENSATION IN A PEDAL MAP

(75) Inventors: Per Persson, Gothenburg (SE); Bengt Norén, Mölndal (SE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/656,271

(22) Filed: Sep. 5, 2003

(65) Prior Publication Data

US 2005/0051131 A1 Mar. 10, 2005

(51) Int. Cl.[7] ..... F02D 41/16
(52) U.S. Cl. ..... 123/339.14; 123/350; 701/110
(58) Field of Search ..... 123/339.1, 339.14, 123/339.19, 339.2, 339.21, 352–355, 361, 399; 701/110

(56) References Cited

U.S. PATENT DOCUMENTS 4,418,810 A * 12/1983 Windsor ..... 477/176
6,119,063 A 9/2000 Hieb et al. ..... 701/110
6,651,619 B2 * 11/2003 Ogiso ..... 123/339.19

* cited by examiner

*Primary Examiner*—Tony M. Argenbright
(74) *Attorney, Agent, or Firm*—Gregory P. Brown; Ford Global Technologies LLC

(57) ABSTRACT

A method of controlling torque output of an engine including receiving an acceleration pedal position signal and receiving an engine speed signal. The method also includes calculating a modified engine speed signal as a function of the engine speed signal and the acceleration pedal position signal. The method further includes requesting engine output torque as a function of the acceleration pedal position signal and the modified engine speed signal.

19 Claims, 3 Drawing Sheets

IDLE SPEED COMPENSATION IN A PEDAL MAP

BACKGROUND OF THE INVENTION

The present invention relates to an engine controller, and in particular to a method for controlling torque output of an engine during idling.

Torque based control systems are used in motor vehicles to compute a torque request of a driver of the vehicle as a function of speed of an engine of the vehicle and a position of an acceleration pedal of the vehicle. FIG. 1 illustrates a torque output map used in a typical torque based control system. The typical torque based control system controls the torque output of the engine of the vehicle on a crankshaft according to the engine torque request read from the torque output map. The torque output map includes an X-axis 10 having values for the speed of the engine (in, e.g., revolutions per minute). The torque output map also includes lines 12 representing a percent of depression of the acceleration pedal. In FIG. 1, the top line 12*a* represents full depression of the acceleration pedal and the bottom line 12*b* represents zero depression of the acceleration pedal. The torque output map further includes a Y-axis 14 having values for the desired output torque. The desired output torque can be determined from the torque output map by reading the value on the Y-axis 14 corresponding to a meeting point of the line 12 representing the percentage of depression of the acceleration pedal and the engine speed on the X-axis 10. Once the desired output torque is determined, the torque based control system sets the torque of the crankshaft equal to the desired output torque.

During idling (i.e., when the engine is at idle speed), the desired output torque should be set at zero such that the vehicle does not have a positive output torque or negative output torque on the crankshaft. Therefore, at idle speed, the line 12*b* for zero depression of the acceleration pedal should meet the idle speed on the X-axis 10 (i.e., the torque output map, or Y-axis value, is zero). However, the engine speed can sometimes increase or decrease during idling. For example, the vehicle may experience a change in temperature during idling. When the engine speed increases, the desired output torque read from the torque output map will decrease. Vehicles with torque based control systems can include idle speed controllers (typically a PI-controller) to counteract the increase in idle engine speed. Therefore, when the engine speed increases during idling, the idle speed controller decreases the engine speed until the line 12*b* for zero depression of the acceleration pedal once again meets the idle speed on the X-axis 10 to thereby set the desired output torque at zero. Likewise, when the engine speed decreases, the desired output torque read from the torque output map will increase. When the engine speed decreases during idling, the idle speed controller increases the engine speed until the line 12*b* for zero depression of the acceleration pedal once again meets the idle speed on the X-axis 10 to thereby set the desired output torque at zero. However, the idle speed controller can take time to counteract any change in engine speed during idling. The torque output map is normally designed such that the nominal engine idle speed is the speed where line 12*b* in FIG. 1 intersects the X-axis. However, during engine operation, the engine management system may use another set point speed for the idle speed controller, and this will be the actual engine idle speed. A reason for increasing the engine idle speed may be to heat the catalyst during startup.

Accordingly, a quick response to changes in engine speed during idling is desired.

SUMMARY OF THE INVENTION

One aspect of the present invention is to provide a method of controlling torque output of an engine comprising receiving an acceleration pedal position signal and receiving an engine speed signal. The method also includes calculating a modified engine speed signal as a function of the engine speed signal and the acceleration pedal position signal. The method further includes requesting engine output torque as a function of the acceleration pedal position signal and the modified engine speed signal.

Another aspect of the present invention is to provide a method of controlling torque output of an engine during idling comprising determining an acceleration pedal position, determining engine speed of the engine and determining requested engine output torque from a torque output map as a function of the acceleration pedal position and the engine speed, wherein the torque output map includes axes of engine speed and output torque request. The method also includes modifying at least a portion of at least one of the axes of engine speed and output torque request during idling of the engine such that the requested engine output torque is zero torque during idling.

Yet another aspect of the present invention is to provide a method of controlling torque output of an engine comprising receiving an acceleration pedal position signal, receiving an engine speed signal and determining requested engine output torque as a function of the acceleration pedal position signal and the engine speed signal. The method also includes multiplying the engine speed signal by a nominal engine idle speed value over an actual engine idle speed value when the engine speed signal is below a first predetermined value and when the acceleration pedal position signal is below a second predetermined value.

These and other features, advantages, and objects of the present invention will be further understood and appreciated by those skilled in the art by reference to the following specification, claims and appended drawings.

DETAILED DESCRIPTION OF THE PREFERRED EMBODIMENTS

For purposes of description herein, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
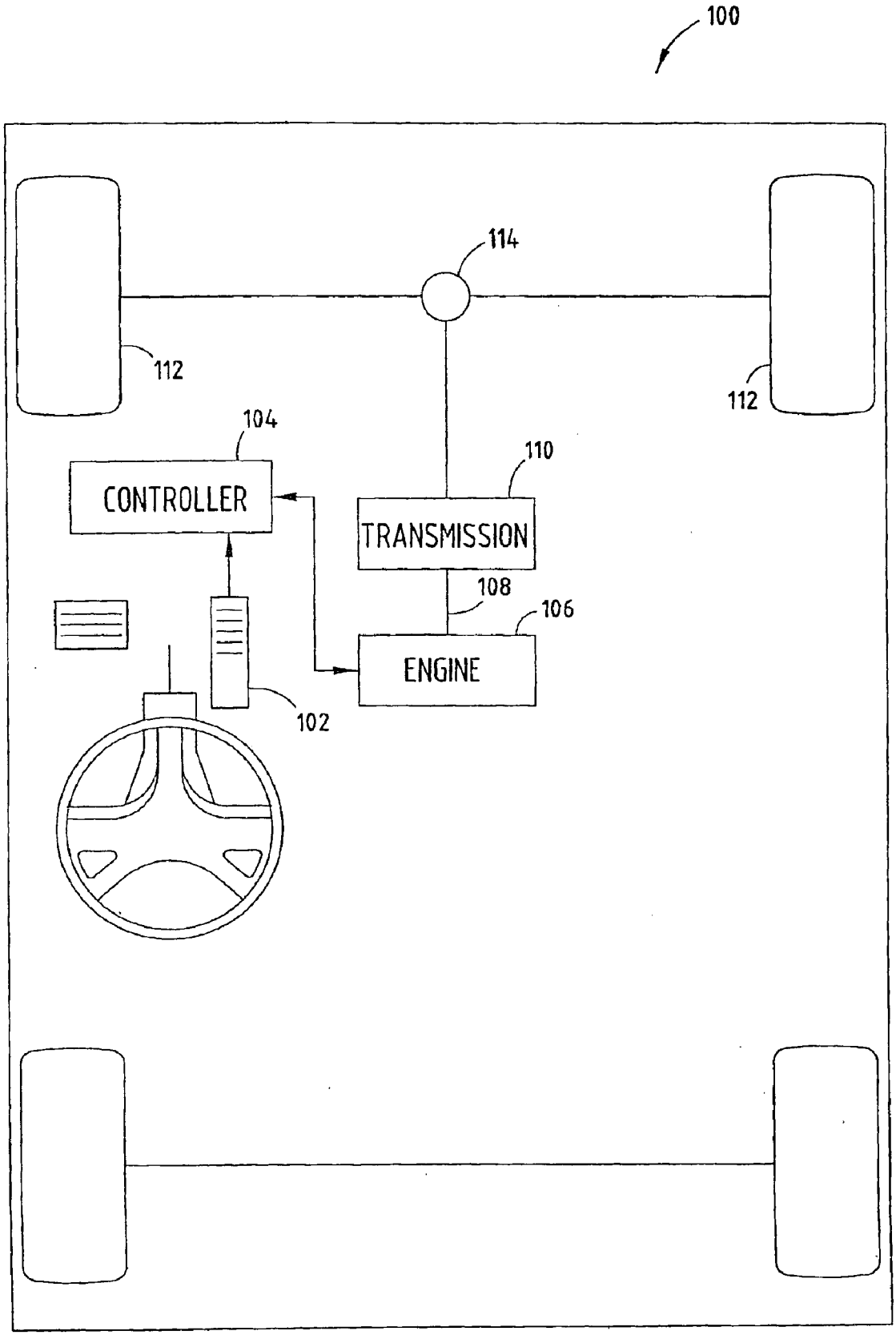
FIG. 2 is a schematic diagram of a vehicle using the torque output map of the present invention.

The reference number 100 (FIG. 2) generally designates a vehicle embodying a pedal map of the present invention. In the illustrated example, the vehicle 100 includes an acceleration pedal 102 communicating with an engine controller 104 that controls an engine 106. The engine 106 has an output (represented schematically at 108). In the illustrated embodiment, the output of the engine 106 is mechanically communicated to a transmission 110. The transmission 110 thereafter outputs torque to a pair of front wheels 112 through a front differential 114. Therefore, the vehicle 10 is a front wheel drive vehicle. However, it is contemplated that the pedal map of the present invention can be used in a four-wheel drive vehicle.

In the present invention, the controller 104 is a torque based control system that uses a torque output map (e.g., FIG. 3) to maintain an output torque request at zero during idling. The output torque request remains at zero using the torque output map of the present invention even when a speed of the engine 106 increases or decreases. Therefore, the present invention will allow an idle speed controller (which can be integrated into or separate from the controller 104) to easily maintain a zero output torque request.

The torque based control system of the present invention has a first input of an acceleration pedal position signal and a second input of an engine speed signal. The acceleration pedal position signal is determined from a position of an acceleration pedal 102 in the vehicle 100. The position of the acceleration pedal 102 is preferably measured directly by electrical means. The position of the acceleration pedal 102 can also be determined by measuring the position of the acceleration pedal, measuring the position of the valve controlling the volume of vaporized fuel charge delivered to the cylinders of the engine of the vehicle, measuring any electrical or mechanical element positioned in the communication line between the acceleration pedal and the valve controlling the fuel charge delivered to the engine, measuring the vacuum level in the engine manifold or any other means of measuring the position of the acceleration pedal. The engine speed signal can be determined using standard RPM (revolution per minute) determining technology or in any other manner known to those skilled in the art.

Figure 3:
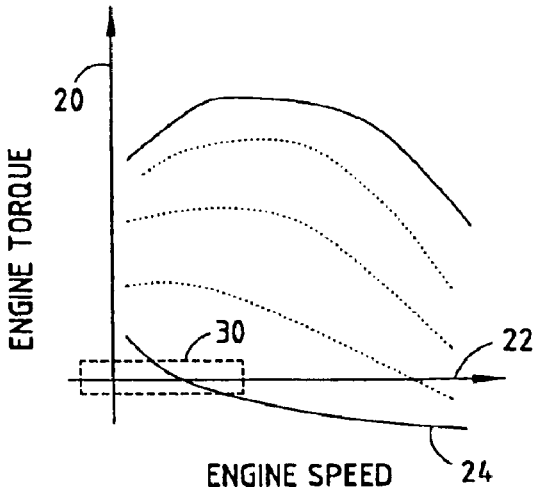
FIG. 3 is a diagram illustrating a torque output map according to a first embodiment of the present invention.

FIG. 3 illustrates a torque output map used by the torque based control system according to a first embodiment of the present invention. In the present invention, the Y-axis 20 of the torque output map represents the output torque request and the X-axis 22 of the torque output map represents the engine speed. The present invention modifies at least a portion of at least one of the axes of engine speed and output torque request during idling of the engine such that the requested engine output torque is zero torque during idling. In a first preferred embodiment, the X-axis 22 representing engine speed is modified in the torque output map by multiplying a portion (box 30 in FIG. 3) of the X-axis 22 by $s_{ai}/s_{ai}$, wherein $s_{ai}$=an actual idle speed (i.e., current idle speed) and $s_{ni}$=a nominal idle speed. The nominal idle speed is the engine speed where the current position of the acceleration pedal will produce a zero value for the output torque request given the original torque output map. In the first preferred embodiment, the X-axis is preferably only modified when the pedal position and the engine speed are below certain predetermined values. Preferably, the X-axis is only modified when the acceleration pedal position is below a certain value (line 24 in FIG. 3) and the engine speed is below approximately 1500 rpm. The X-axis is modified when the acceleration pedal position is below a certain value, such that torque based control system produces a zero output torque request from the X-axis corresponding to the idle speed.

Figure 4:
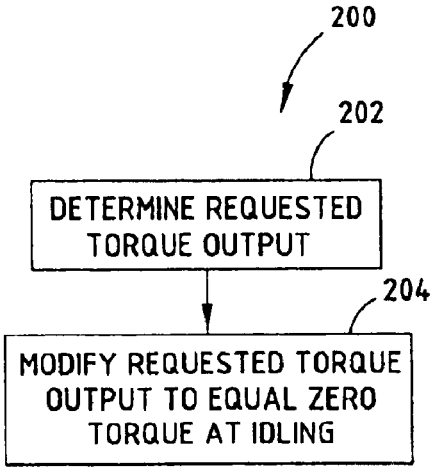
FIG. 4 is a flow diagram illustrating operation for controlling an output torque of an engine according to the first embodiment of the present invention.

Referring to FIG. 4, a method 200 of controlling a torque output of the engine 106 is shown. Beginning at step 202 of the method 200 of controlling the torque output of the engine 106, a requested engine output torque as a function of the acceleration pedal position signal and the engine speed signal is determined. Thereafter, the requested engine output torque is modified such that the requested engine output torque is zero torque during idling at step 204. In the first preferred embodiment of the present invention, at least a portion of at least one of the axes of engine speed and output torque request is modified during idling of the engine such that the requested engine output torque is zero torque during idling at step 204. In another alternative method of the first embodiment of the present invention, the engine speed signal is multiplied by a nominal engine idle speed value over an actual engine idle speed value at step 204 if the engine speed signal is below a first predetermined value and the acceleration pedal position signal is below a second predetermined value.

Figure 1:
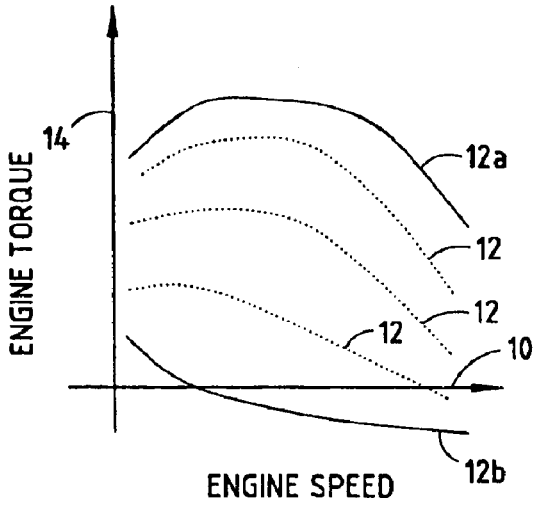
FIG 1 Prior Art
FIG. 1 is a diagram illustrating a prior art torque output map.
Figure 5:
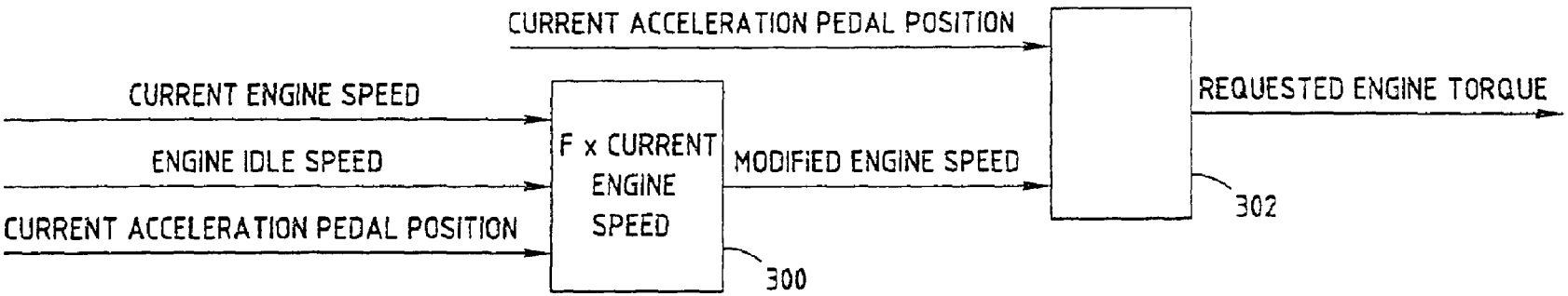
FIG. 5 is a flow diagram illustrating operation for controlling an output torque of an engine according to a second embodiment of the present invention.

FIG. 5 illustrates a flow chart used to maintain the output torque request at zero during idling according to a second embodiment of the present invention. According to the second embodiment of the present invention, the prior art torque output map (FIG. 1) is used, but the engine speed used to determine the torque output is modified according to FIG. 5 before the engine speed is input into the torque output map. As illustrated in FIG. 5, the current engine speed, the engine idle speed and the current acceleration pedal position are input into a functional block 300 to determine a modified engine speed. The current engine speed and the current acceleration pedal position are measured as discussed above in the first embodiment of the present invention. The engine idle speed is the speed where line 12*b* in FIG. 1 crosses the X-axis for engine speed (i.e., 0 engine torque for 0 percent acceleration pedal depression). Thereafter, a modified engine speed, along with the current acceleration pedal position, is input into the torque output map of FIG. 1 (block 302 in FIG. 5) to determine the requested engine torque.

Figure 6:
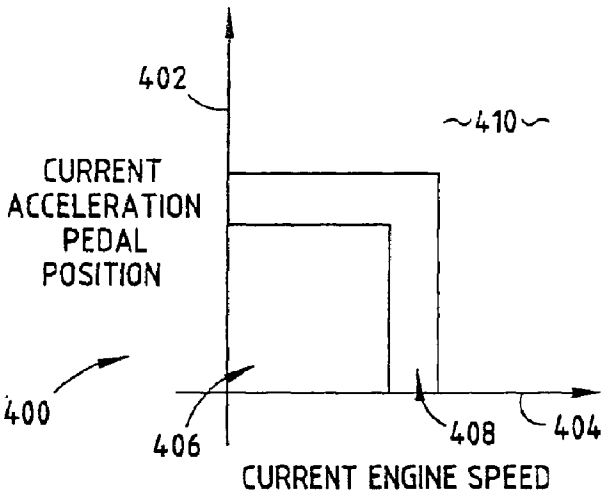
FIG. 6 is a diagram illustrating the engine speed modifier used in the flow diagram of FIG. 5.

In the illustrated example, the modified engine speed is a function of current engine speed, engine idle speed and current acceleration pedal position. The modified engine speed is determined by multiplying the current engine speed by a variable F determined according to FIG. 6. FIG. 6 illustrates a graph 400 having current acceleration pedal position as the Y-axis 402 and current engine speed as the X-axis 404. The graph 400 includes a first section 406 wherein the current acceleration pedal position is below a first predetermined position and the current engine speed is below a first predetermined speed. The graph 400 also includes a second section 408 wherein the current acceleration pedal position is above the first predetermined position, but below a second predetermined position, and the current engine speed is above the first predetermined speed, but below a second predetermined speed. Furthermore, the graph 400 includes a third section 410 wherein the current acceleration pedal position is above the second predetermined position and the current engine speed is above the second predetermined speed. When the current acceleration pedal position and the current engine speed are located in the third section 410 of the graph 400, the variable F is one 1.

Therefore, in this situation, the modified engine speed is identical to the current engine speed. When the current acceleration pedal position and the current engine speed are located in the first section 406 of the graph 400, the variable F is equal to a nominal engine idle speed over the current engine idle speed. Therefore, in this situation, when the engine speed is equal to the engine idle speed, the modified engine speed is equal to the engine idle speed. Furthermore, when the current acceleration pedal position and the current engine speed are located in the second section 408 of the graph 400, the variable F is interpolated between 1 and a number equal to the nominal engine idle speed over the current engine idle speed dependent on the distance of the point in the second section 408 between the first section 406 and the third section 410.

The present invention makes it possible to have only one pedal map for driving and idling. By modifying the torque request for low values of acceleration pedal position and engine speed only, it is possible to use the original pedal map both for driving and idling, and thus avoid having complex software handling two different driving modes and transitions between these modes. The area in which the pedal map is modified is not used very much for normal driving, and a modification in this area does not disturb the overall impression of the pedal map.

In a vehicle using the torque based engine control system of the present invention, a single torque output map can be used for numerous vehicles, thereby allowing easier calibration of the vehicles and engines and thereby allowing better performance for the vehicle than if the idle speed controller handled any possible torque offset at idle speed as in the prior art control systems. Furthermore, vehicles will be able to easily handle various idle speeds without a need to offset torque at the different idle speeds. Moreover, the torque based engine control system of the present invention can be used with any vehicle control system that controls engine output and with any engine (e.g., automatic or manual transmission, aspirated or turbocharged, electronically controlled, etc.)

It will be readily appreciated by those skilled in the art that modifications may be made to the invention without departing from the concepts disclosed herein. Such modifications are to be considered as included in the following claims, unless these claims by their language expressly state otherwise.

We claim:

1. A method of controlling torque output of an engine comprising:

receiving an acceleration pedal position signal;

receiving an engine speed signal;

calculating a modified engine speed signal as a function of the engine speed signal and the acceleration pedal position signal; and requesting engine output torque as a function of the acceleration pedal position signal and the modified engine speed signal.

2. The method of controlling torque output of an engine of claim 1, wherein:

calculating the modified engine speed signal includes multiplying the engine speed signal by a nominal idle engine speed value over an actual engine idle speed value when the engine speed signal is below a first predetermined value and when the acceleration pedal position signal is below a second predetermined value.

3. The method of controlling torque output of an engine of claim 2, wherein:

calculating the modified engine speed signal includes multiplying the engine speed signal by a first fraction of the nominal idle engine speed value over a second fraction of the actual engine idle speed value when the engine speed signal is between the first predetermined value and a third predetermined value and when the acceleration pedal position signal is between the second predetermined value and a fourth predetermined value.

4. The method of controlling torque output of an engine of claim 3, wherein:

calculating the modified engine speed signal includes multiplying the engine speed signal by one when the engine speed signal is above the third predetermined value and when the acceleration pedal position signal is above the fourth predetermined value.

5. The method of controlling torque output of an engine of claim 1, wherein:

calculating the modified engine speed signal includes multiplying the engine speed signal by a first fraction of the nominal idle engine speed value over a second fraction of the actual engine idle speed value when the engine speed signal is between a first predetermined value and a second predetermined value and when the acceleration pedal position signal is between a third predetermined value and a fourth predetermined value.

6. The method of controlling torque output of an engine of claim 5, wherein:

calculating the modified engine speed signal includes multiplying the engine speed signal by one when the engine speed signal is above the second predetermined value and when the acceleration pedal position signal is above the fourth predetermined value.

7. The method of controlling torque output of an engine of claim 1, wherein:

calculating the modified engine speed signal includes multiplying the engine speed signal by one when the engine speed signal is above a first predetermined value and when the acceleration pedal position signal is above a second predetermined value.

8. The method of controlling torque output of the engine of claim 1, further including:

determining an acceleration pedal position.

9. The method of controlling torque output of the engine of claim 1, further including:

determining engine speed of the engine.

10. A method of controlling torque output of an engine during idling comprising:

determining an acceleration pedal position;

determining engine speed of the engine;

determining requested engine output torque from a torque output map as a function of the acceleration pedal position and the engine speed, wherein the torque output map includes axes of engine speed and output torque request; and modifying at least a portion of at least one of the axes of engine speed and output torque request during idling of the engine such that the requested engine output torque is zero torque during idling.

11. The method of controlling torque output of the engine of claim 10, wherein:

modifying at least one of the axes of engine speed and output torque request comprises modifying the axis of engine speed.

12. The method of controlling torque output of the engine of claim 11, wherein:

modifying the axis of engine speed includes multiplying the axis of engine speed by an actual idle speed and dividing the axis of engine speed by a nominal idle speed.

13. The method of controlling torque output of the engine of claim 10, wherein:

modifying at least one of the axes of engine speed and output torque request comprises modifying the axis of output torque request.

14. A method of controlling torque output of an engine comprising:

receiving an acceleration pedal position signal;

receiving an engine speed signal;

determining requested engine output torque as a function of the acceleration pedal position signal and the engine speed signal; and multiplying the engine speed signal by a nominal engine idle speed value over an actual engine idle speed value when the engine speed signal is below a first predetermined value and when the acceleration pedal position signal is below a second predetermined value.

15. The method of controlling torque output of the engine of claim 14, further including:

determining an acceleration pedal position.

16. The method of controlling torque output of the engine of claim 15, wherein:

the second predetermined value is zero percent depression of the acceleration pedal.

17. The method of controlling torque output of the engine of claim 14, further including:

determining engine speed of the engine.

18. The method of controlling torque output of the engine of claim 17, wherein:

the second predetermined value is zero percent depression of the acceleration pedal.

19. The method of controlling torque output of the engine of claim 14, wherein:

the second predetermined value is zero percent depression of the acceleration pedal.

* * * * *